US007630889B2

(12) United States Patent
Murashima

(10) Patent No.: US 7,630,889 B2
(45) Date of Patent: Dec. 8, 2009

(54) CODE CONVERSION METHOD AND DEVICE

(75) Inventor: Atsushi Murashima, Minato-ku (JP)

(73) Assignee: NEC Corporation, Tokyo (JP)

( * ) Notice: Subject to any disclaimer, the term of this patent is extended or adjusted under 35 U.S.C. 154(b) by 817 days.

(21) Appl. No.: 10/552,824

(22) PCT Filed: Mar. 31, 2004

(86) PCT No.: PCT/JP2004/004605

§ 371 (c)(1),
(2), (4) Date: Oct. 7, 2005

(87) PCT Pub. No.: WO2004/090869

PCT Pub. Date: Oct. 21, 2004

(65) Prior Publication Data

US 2006/0217980 A1 Sep. 28, 2006

(30) Foreign Application Priority Data

Apr. 8, 2003 (JP) ..... 2003-104454

(51) Int. Cl.
*G10L 19/00* (2006.01)

(52) U.S. Cl. ..... 704/230; 704/229; 704/200.1; 704/216; 704/228

(58) Field of Classification Search ..... 704/226–228, 704/500–504, 200.1, 215, 219, 229, 230, 704/216
See application file for complete search history.

(56) References Cited

U.S. PATENT DOCUMENTS 5,467,367 A * 11/1995 Izumi et al. ..... 375/142
5,581,654 A * 12/1996 Tsutsui ..... 704/200.1
5,694,519 A * 12/1997 Chen et al. ..... 704/228
5,758,316 A * 5/1998 Oikawa et al. ..... 704/200.1
5,787,388 A * 7/1998 Hayata ..... 704/215
5,870,703 A * 2/1999 Oikawa et al. ..... 704/200.1
6,128,592 A * 10/2000 Miyazaki et al. ..... 704/224
6,415,251 B1 * 7/2002 Oikawa et al. ..... 704/200.1
6,661,923 B1 * 12/2003 Koike et al. ..... 382/232

FOREIGN PATENT DOCUMENTS

EP 1 126 439 A2 8/2001
JP 08-130743 A 5/1996

(Continued)

OTHER PUBLICATIONS

I. L.E. Bergeron, "A Spectral Enhancement Procedure for the Wideband/Narrowband Tandem", GTE Sylvania Incorporated Electronics System Group, pp. 330-333.

(Continued)

*Primary Examiner*—Vijay B Chawan
(74) *Attorney, Agent, or Firm*—Sughrue Mion, PLLC

(57) ABSTRACT

A code conversion method for converting first code string data conforming to a first speech coding scheme into second code string data conforming to a second speech coding scheme has the steps of decoding the first code string data to generate a first decoded speech, correcting the signal characteristics of the first decoded speech to generate a second decoded speech, and encoding the second decoded speech in accordance with the second speech coding scheme to generate the second code string data.

26 Claims, 2 Drawing Sheets

FOREIGN PATENT DOCUMENTS

| | | | |
|---|---|---|---|
| JP | 8-146997 | A | 6/1996 |
| JP | 9-50298 | A | 2/1997 |
| JP | 9-190195 | A | 7/1997 |
| JP | 9-261184 | A | 10/1997 |
| JP | 09-326772 | A | 12/1997 |
| JP | 10-63297 | A | 3/1998 |
| JP | 10-116097 | A | 5/1998 |
| JP | 11-187372 | A | 7/1999 |
| JP | 2001-242891 | A | 9/2001 |
| JP | 2001-331199 | A | 11/2001 |
| JP | 2002-202799 | A | 7/2002 |
| JP | 2002-373000 | A | 12/2002 |
| WO | WO 99/38155 | A1 | 7/1999 |

OTHER PUBLICATIONS

Masanoa Suzuki et al., "3G Mobile Communication Oriented Voice Code Conversion Technology", IEICE Technical Report, Apr. 2001, pp. 47-52, Information and Communication Engineers, Japan.

M. Schroeder, "Code excited linear prediction: High quality speech at very low bit rates," Proc. of IEEE Int. Conf. on Acoust., Speech and Signal Processing, pp. 937-940, 1985.

3GPP standard: "AMR Speech codec: Transcoding functions" (3GPP TS 26.090)Japenese Patent Publication No. 8-130743, published May 21, 1996.

* cited by examiner

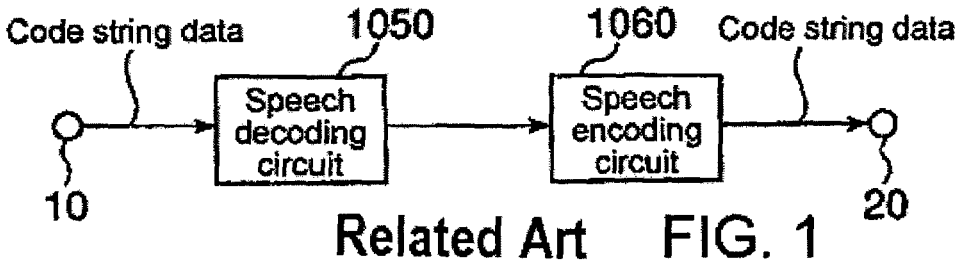
Related Art FIG. 1
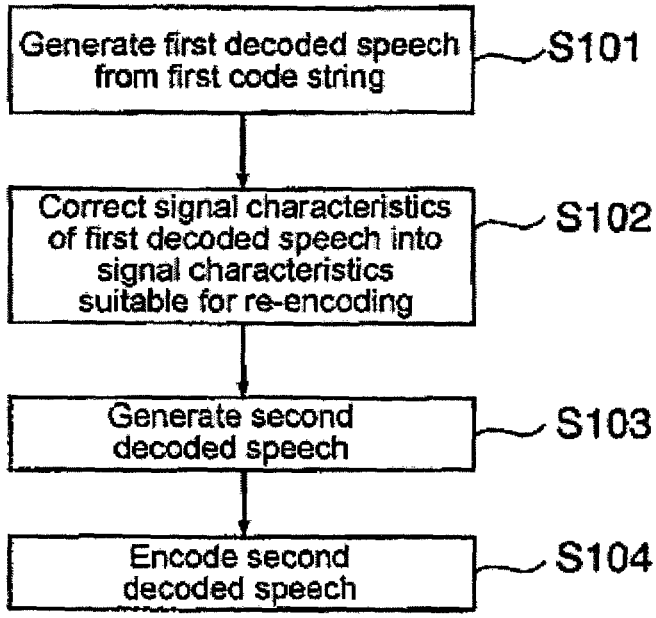
FIG. 2
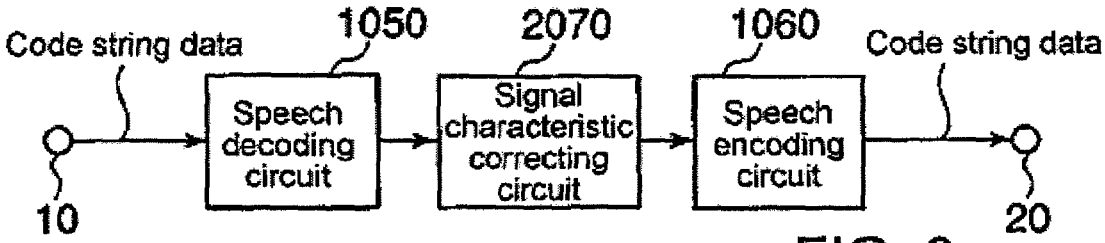
FIG. 3

CODE CONVERSION METHOD AND DEVICE

TECHNICAL FIELD

The present invention relates to an encoding and decoding method for transmitting or storing a speech signal at low bit rates, and more particularly, to a code conversion method and apparatus for converting, in a high sound quality and with a small amount of calculations, codes generated by encoding a speech in accordance with a certain scheme to codes which can be decoded in accordance with another scheme.

BACKGROUND ART

As a method of efficiently encoding speech signals at middle bit rates or low bit rates, one widely used method separates a speech signal into an LP (Linear Prediction) filter and an excitation signal for driving it and then encodes the speech signal. One representative method is CELP (Code Excited Linear Prediction). CELP drives an LP filter, which has set therein LP coefficients representative of frequency characteristics of an input speech, with an excitation signal represented by the sum of an adaptive codebook (ACB) representative of the pitch period of the input speech and a fixed codebook (FCB) made up of a random number and a pulse to generate a synthetic speech signal. In this event, an ACB component and an FCB component are multiplied by gains (ACB gain and FCB gain), respectively. For CELP, see, for example, M. Schroeder, "Code excited linear prediction: High quality speech at very low bit rates," Proc. of IEEE Int. Conf. on Acoust., Speech and Signal Processing, pp. 937-940, 1985.

Assuming, for example, an interconnection between a 3G (Third Generation) mobile network and a wired packet network, a problem arises in that these networks cannot be directly connected because the respective networks employ different standard speech encoding scheme. As a solution to this, a tandem connection can be contemplated.

FIG. 1 illustrates an example of a conventional code conversion apparatus based on the tandem connection, where codes generated by encoding a speech using a first speech coding scheme are converted into codes which can be decoded in accordance with a second speech coding scheme. The second speech coding scheme is generally different from the first speech coding scheme. In the following, for simplicity of description, the first speech coding scheme is simply called "Scheme 1," and codes generated by encoding a speech using the first speech coding scheme is called "first code string data." Likewise, the second speech coding scheme is simply called "Scheme 2," and codes generated by encoding a speech using the second speech coding scheme is called "second code string data." Assume that code string data is communicated at a frame period (for example, a period of 20 milliseconds) which is the processing unit of speech encoding/decoding. For a speech encoding method and decoding method, see the aforementioned Schroeder's article, or 3GPP standard: "AMR Speech codec: Transcoding functions" (3GPP TS 26.090).

Referring to FIG. 1, the following description will be given of a conventional code conversion apparatus based on the tandem connection.

In the code conversion apparatus, input terminal 10, speech decoding circuit 1050, speech encoding circuit 1060, and output terminal 20 are connected in series in this order. Speech decoding circuit 1050 decodes a speech from first code string data applied thereto through input terminal 10 by a decoding method conforming to Scheme 1, and supplies the decoded speech to speech encoding circuit 1060 as a first decoded speech. Speech encoding circuit 1060 receives the first decoded speech delivered from speech decoding circuit 1050, and delivers code string data, generated by encoding the first decoded speech by a second speech coding method, through output terminal 20 as second code string data.

However, the foregoing conventional code conversion apparatus based on the tandem connection re-encodes a decoded speech signal, generated by once decoding applied first code string data by the speech decoding circuit of Scheme 1, as it is by the speech encoding circuit of Scheme 2 even though its signal characteristics are not suitable for re-encoding due to a deterioration resulting from the coding, and therefore has a challenge that the speech quality deteriorates in a finally decoded speech if the second code string data generated by these code conversions is decoded in accordance with Scheme 2.

DISCLOSURE OF THE INVENTION

It is an object of the present invention to provide a code conversion method for decoding and re-encoding an encoded speech, which is capable of reducing a deterioration in speech quality of a finally generated speech signal.

It is another object of the present invention to provide a code conversion apparatus for decoding and re-encoding an encoded speech, which is capable of reducing a deterioration in speech quality of a finally generated speech signal.

The first object of the present invention is achieved by a code conversion method for converting first code string data conforming to a first speech coding scheme into second code string data conforming to a second speech coding scheme. The method has the steps of decoding the first code string data to generate a first decoded speech, correcting the signal characteristics of the first decoded speech to generate a second decoded speech, and encoding the second decoded speech in accordance with the second speech coding scheme to generate the second code string data.

In the code conversion method of the present invention, in the step of generating the second decoded speech, the signal characteristics are preferably corrected by a filter having characteristics which vary in accordance with the characteristics of the first decoded speech. Also, in the step of generating the second decoded speech, the signal characteristics of the first decoded speech are preferably corrected into signal characteristics suitable for re-encoding.

The second object of the present invention is achieved by a code conversion apparatus for converting first code string data conforming to a first speech coding scheme into second code string data conforming to a second speech coding scheme. The code conversion apparatus has a speech decoding circuit for decoding the first code string data to generate a first decoded speech, a signal characteristic correcting circuit for correcting signal characteristics of the first decoded speech to generate a second decoded speech, and a speech encoding circuit for encoding the second decoded speech in accordance with the second speech coding scheme to generate the second code string data.

In the code conversion apparatus of the present invention, the signal correcting circuit preferably corrects the signal characteristics of the first decoded speech into signal characteristics suitable for re-encoding to generate the second decoded speech. Also, the signal characteristic correcting circuit preferably corrects the signal characteristics of the first decoded speech using a filter having characteristics which vary in accordance with the characteristics of the first decoded speech to generate the second decoded speech.

In the present invention, the filter used for correcting the signal characteristics of the first decoded speech is preferably an inverse filter to a post filter, an emphasis filter having characteristics for emphasizing high-band components of frequency, or a filter which is a combination of the two. Also, the filter characteristics are preferably varied using at least one of frame type information included in the first code string data, the size of the first code string data, and a characteristic amount which can be calculated from the first decoded speech.

A decoded speech signal generated by decoding by a speech decoding circuit of Scheme 1 generally has signal characteristics which are not suitable for re-encoding due to a deterioration resulting from the coding. When the decoded speech signal is re-encoded as it is by a speech encoding circuit of Scheme 2, a degradation in sound quality is prominent in a speech signal decoded from second code string data after the code conversion. In the present invention, the first code string data is decoded from the first code string data by the speech decoding circuit of Scheme 1 to generate a decoded speech signal, the signal characteristics of which are corrected, and subsequently, the corrected decoded speech signal is re-encoded by the speech encoding circuit of Scheme 2. As a result, according to the present invention, the deterioration in sound quality is reduced in a speech signal decoded from the second code string data.

BRIEF DESCRIPTION OF THE DRAWINGS

FIG. 1 is a block diagram illustrating the configuration of a conventional code conversion apparatus based on a tandem connection;

FIG. 2 is a flow chart showing a processing procedure of a code conversion based on the present invention;

FIG. 3 is a block diagram illustrating the configuration of a code conversion apparatus according to a first embodiment of the present invention;

BEST MODE FOR CARRYING OUT THE INVENTION

Figure 4:
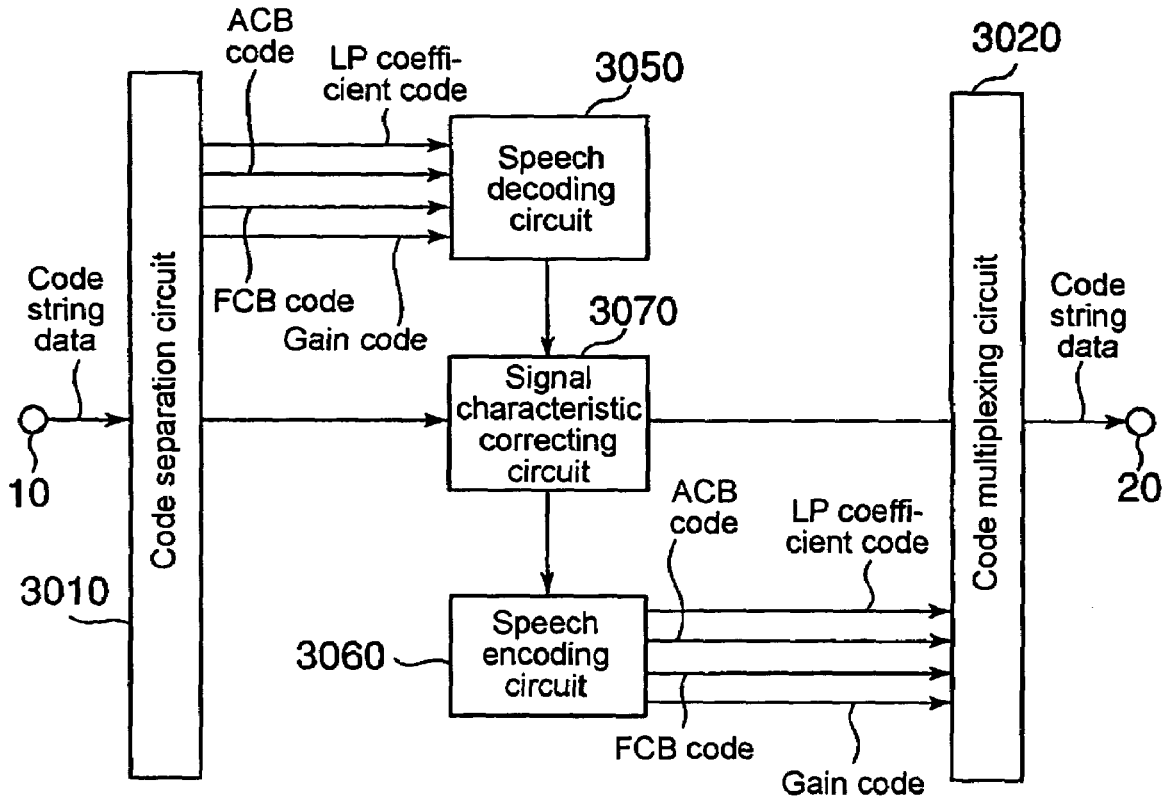
FIG. 4 is a block diagram illustrating the configuration of a code conversion apparatus according to a second embodiment of the present invention.

FIG. 2 shows the flow of processing based on a code conversion method of the present invention. The code conversion method based on the present invention has the following steps (a) to (c):

(a): generating a first decoded speech from first code string data by a decoding method of Scheme 1 (step S101);

(b): correcting the first decoded speech to have signal characteristics suitable for re-encoding using a filter to generate a second decoded speech (steps S102, 103); and (c) encoding the second decoded speech by a second encoding method to generate second code string data (step S104).

Thus, in the present invention, a decoded speech signal generated by decoding the first code string data by the speech decoding circuit of Scheme 1 is corrected using a filter to have signal characteristics suitable for re-encoding, and the corrected decoded speech signal is re-encoded by the speech encoding circuit of Scheme 2. It is therefore possible to reduce a speech quality deterioration in the speech signal decoded from the second code string data after the code conversion, caused by re-encoding the decoded speech having signal characteristics unsuitable for re-encoding due to a deterioration due to the encoding, as it is, by the speech encoding circuit of Scheme 2.

Next, description will be given of a code conversion apparatus based on the present invention. In FIG. 3 which illustrates a code conversion apparatus according to a first embodiment of the present invention, elements identical or similar to those in FIG. 1 are designated the same reference numerals.

The code conversion apparatus illustrated in FIG. 3 comprises input terminal 10; speech decoding circuit 1050 which is supplied with first code string data from input terminal 10; signal characteristic correcting circuit 2070 which is supplied with the output of speech decoding circuit 1050; speech encoding circuit 1060 which is supplied with the output of signal characteristic correcting circuit 2070; and output terminal 20 for delivering second code string data generated from speech encoding circuit 1060 to the outside. Speech decoding circuit 1050 generates a first decoded speech from the first code string data by a decoding method of Scheme 1. Signal characteristic correcting circuit 207 corrects the first decoded speech to have signal characteristics suitable for re-encoding using a filter to generate a second decoded speech. Speech encoding circuit 1060 encodes the second decoded speech by a second encoding method to generate second code string data. Input terminal 10, output terminal 20, speech decoding circuit 1050, and speech encoding circuit 1060 are the same as those illustrated in FIG. 1.

In the following, a detailed description will be given of signal characteristic correcting circuit 2070 which is a difference in configuration between the code conversion apparatus illustrated in FIG. 3 and the conventional code conversion apparatus illustrated in FIG. 1.

Signal characteristic correcting circuit 2070 receives the first decoded speech delivered from speech decoding circuit 1050, and applies speech encoding circuit 1060 with a signal generated by driving a filter represented by transfer function F(z) with the first decoded speech, as a second decoded speech. Here, filter F(z) has such signal characteristics that correct the first decoded speech to have signal characteristics suitable for re-encoding.

In many cases, a post filter is employed in a speech decoding circuit for improving a subjective sound quality, but the sound quality deteriorates if a post-filtered decoded speech is re-encoded. Thus, the sound quality can be improved by applying the decoded speech to a filter inverse to the post filter. Filter F(z) can be expressed by Equation (1) when the transfer function of the post filter is P(z):

$$F(z)=F1(z)=1/P(z) \tag{1}$$

Here, for details on the post filter, see, for example, a description in 3GPP TS 26.090, Section 6.2.

Also, in the aforementioned deterioration in sound quality, muffled feeling of sound often constitutes a significant factor. As such, filter F(z) may be a filter which has such frequency characteristics that emphasize high-band components of frequency. In this event, F(z) can be expressed, for example, by Equation (2):

$$F(z)=F2(z)=1-u(1/z) \tag{2}$$

where u is a coefficient (for example, 0.2) which represents the degree of emphasis for high-band components.

Further, the aforementioned F1(z) and F2(z) may be combined. In this event, F(z) can be expressed by Equation (3):

$$F(Z)=F3(z)=F1(z)F2(z)=(1-u(1/z))/P(z) \tag{3}$$

As is apparent from the foregoing, this embodiment is advantageous in that a speech decoding circuit and a speech encoding circuit, conforming to a standard scheme, can be utilized as they are because there is no need for adapting a speech decoding circuit and a speech encoding circuit which form part of a conventional code conversion circuit.

Next, a description will be given of a code conversion apparatus according to a second embodiment of the present invention. In this second embodiment, the filter characteristics of the signal characteristic correcting circuit in the code conversion apparatus of the aforementioned embodiment are made variable in accordance with the characteristics of a speech signal. In FIG. 4 which illustrates the code conversion apparatus of the second embodiment, elements identical or similar to those in the third embodiment are designated the same reference numerals.

As illustrated in FIG. 4, in the code conversion apparatus of the second embodiment, speech decoding circuit 1050 shown in FIG. 3 can be regarded as being composed of code separation circuit 3010 and speech decoding circuit 3050. Likewise, speech encoding circuit 1060 shown in FIG. 3 is regarded as being composed of code multiplexing circuit 3020 and speech encoding circuit 3060.

Code separation circuit 3010 separates a header and a payload from first code string data applied thereto through input terminal 10. The header includes frame type information. By referencing the frame type information, it is possible to distinguish whether a signal decoded from the code string data corresponds to a speech section or a silent section. Here, for details on the frame type information, see, for example, 3GPP standard: "AMR Speech codec frame structure" (3GPP TS 26.101). The payload contains codes corresponding to speech parameters. The speech parameters in code string data include, for example, an LP coefficient, ACB, FCB, ACB, and gains (ABC gain and FCB gain). Codes corresponding to the LP coefficient, ACB, FCB, and gains are designated by a first LP coefficient code, a first ACB code, a first FCB code, and a first gain code, respectively. Code separation circuit 3010 delivers the frame type information to signal characteristic correcting circuit 3070, and delivers the first LP coefficient code, first ACB code, first FCB code, and first gain code to speech decoding circuit 3050.

Speech decoding circuit 3050 receives the first LP coefficient code, first ACB code, first FCB code, and first gain code delivered from code separation circuit 3010, decodes a speech from these codes by a decoding method of Scheme 1, and delivers the decoded speech to signal characteristic correcting circuit 3070 as a first decoded speech.

Speech encoding circuit 3060 receives the second decoded speech delivered from signal characteristic correcting circuit 3070, and encodes the second decoded speech by a second encoding method to generate an LP coefficient code, an ACB code, an FCB code, and a gain code. Then, these codes are delivered to code multiplexing circuit 3020 as a second LP coefficient code, a second ACB code, a second FCB code, and a second gain code, respectively.

Code multiplexing circuit 3020 receives the second LP coefficient code, second ACB code, second FCB code, and second gain code delivered from speech encoding circuit 3060, and multiplexes them to generate code string data which is delivered through output terminal 20 as second code string data.

Signal characteristic correcting circuit 3070 receives the first decoded speech delivered from speech decoding circuit 3050, and the frame type information delivered from code separation circuit 3010, and delivers a signal, generated by driving a filter represented by transfer function F(z), which is variable in accordance with the frame type information, with the first decoded speech, to speech encoding circuit 3060 as a second decoded speech.

Here, as is the case with the first embodiment, filter F(z) can be expressed by the following equations when a post filter in speech decoding circuit 3050 has a transfer function P(z) represented by P(z).

When the frame type information corresponds to a speech, filter F(z) is expressed by Equation (4):

$$F(z)=F1(z)=1/P(z) \tag{4}$$

When the frame type information corresponds to non-speech, filter F(z) is expressed by Equation (5):

$$F(z)=F1(z)=1 \tag{5}$$

When filter F(z) is a filter which has such frequency characteristics that emphasize high-band components of frequency, F(z) can be expressed, for example, by the following equations.

When the frame type information corresponds to a speech, filter F(z) is expressed by Equation (6):

$$F(z)=F2(z)=1-u(1/z) \tag{6}$$

When the frame type information corresponds to non-speech, filter F(z) is expressed by Equation (7):

$$F(z)=F2(z)=1-v(1/z) \tag{7}$$

where u, v are coefficients which represent the degrees of emphasis on high-band components, and for example, u=0.2, and v=0.1. Further, F1(z) and F2(z) may be combined. In this event, F(z) can be expressed by the following equations.

When the frame type information corresponds to a speech, filter F(z) is expressed by Equation (8):

$$F(z)=F3(z)=F1(z)F2(z)=(1-u(1/z))/P(z) \tag{8}$$

When the frame type information corresponds to non-speech, filter F(z) is expressed by Equation (9):

$$F(z)=F3(z)=F1(z)F2(z)=1-v(1/z) \tag{9}$$

In the example described above, while the frame type information is employed for making the filter characteristics variable in accordance with the characteristics of a speech signal, the size of the first code string data may be employed instead of the frame type information, or a characteristic amount, which can be calculated from the first decoded speech, can be used. The characteristic amount represents the characteristics of a speech signal, and includes, for example, pitch periodicity, gradient of spectrum, power, and the like. Filter characteristics F(z) may be varied in a manner similar to the foregoing example when the characteristic amount corresponds to a speech and when the characteristic amount corresponds to non-speech.

For example, when the power is considered as the characteristic amount, it is contemplated, as the most simple example, to correspond relatively large power to a speech and to correspond small power to non-speech.

When power E corresponds to a speech, filter F(z) is expressed by Equation (10):

$$F(z)=F3(z)=F1(z)F2(z)=(1-u(1/z))/P(z),E>Th \tag{10}$$

When power E corresponds to non-speech, filter F(z) is expressed by Equation (11):

$$F(z)=F3(z)=F1(z)F2(z)=1-v(1/z),E<Th \tag{11}$$

where Th is a certain constant. Also, coefficients u, v may take continuous values as functions of E.

Figure 5:
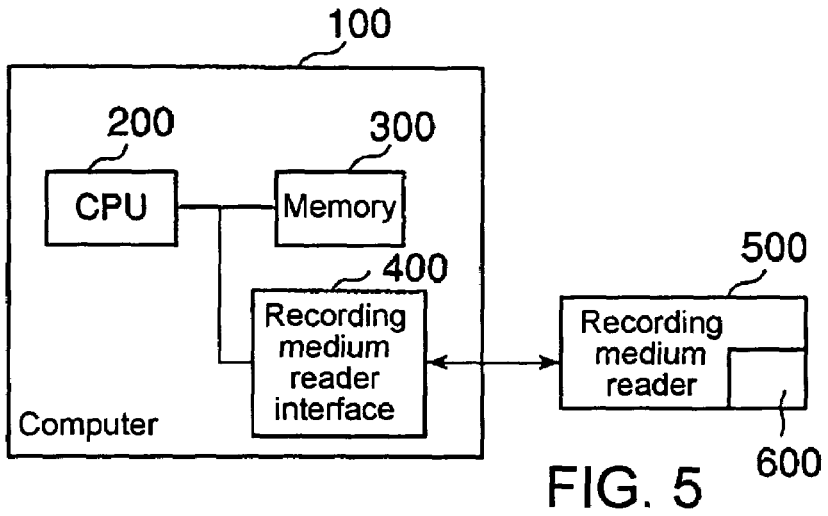
FIG. 5 is a block diagram illustrating another exemplary configuration of a code conversion apparatus based on the present invention.

Each of the code conversion apparatuses described above may be implemented by computer control such as a digital signal processor (DSP). FIG. 5 schematically illustrates the configuration of the apparatus when the code conversion processing in each of the aforementioned embodiments is implemented by a computer.

In computer 100 for executing a program read from recording medium 600, for executing code conversion processing for converting a first code generated by encoding a speech by a first encoding/decoding apparatus into a second code which can be decoded by a second encoding/decoding apparatus, recording medium 600 has recorded thereon a program for executing (a) processing for generating a first decoded speech from first code string data by a decoding method of Scheme 1; (b) processing for correcting the first decoded speech to have signal characteristics suitable for re-encoding using a filter to generate a second decoded signal; and (c) processing for encoding the second decoded speech by a second encoding method to generate second code string data.

This program is read from recording medium 600 into memory 300 through recording medium reader 500 and interface 400. The program may be stored in a non-volatile memory such as ROM, flash memory or the like, whereas the recording medium may include, other than a non-volatile memory, media such as CD-ROM, FD, Digital Versatile Disk (DVD), magnetic tape (MT), and portable hard disk drive (HDD). Further, such a program may have been provided in a server device such that the program is downloaded to a computer through a communication network. Other than a recording medium which has recorded thereon such a program, the scope of the present invention includes a program product which comprises such a program, a communication medium which carries such a program for wired or wireless transmission, and the like.

The invention claimed is:

1. A code conversion method for converting first code string data into second code string data, the method comprising the steps of:

decoding the first code string data with a first speech decoding circuit to generate a first decoded speech;

correcting signal characteristics of the first decoded speech to generate a second decoded speech; and encoding the second decoded speech in accordance with a second speech coding scheme to generate the second code string data.

2. The code conversion method according to claim 1, wherein in the step of generating the second decoded speech, the signal characteristics are corrected by a filter having characteristics which vary in accordance with characteristics of the first decoded speech.

3. The method according to claim 2, wherein the characteristics of the filter are varied using at least one of frame type information included in the first code string data, size of the first code string data, and a representative speech characteristic which can be calculated from the first decoded speech.

4. The code conversion method according to claim 2 or 3, wherein the filter is an inverse filter to a post filter, an emphasis filter having characteristics for emphasizing high-band components of frequency, or a filter which is a combination of the inverse filter and the emphasis filter.

5. The code conversion method according to claim 1, wherein in the step of generating the second decoded speech, the signal characteristics of the first decoded speech are corrected by reducing signal characteristics which cause deterioration of the second decoded speech before re-encoding the first decoded speech.

6. The code conversion method according to claim 5, wherein in the step of generating the second decoded speech, the signal characteristics are corrected by a filter having characteristics which vary in accordance with characteristics of the first decoded speech.

7. The method according to claim 6, wherein the characteristics of the filter are varied using at least one of frame type information included in the first code string data, size of the first code string data, and a representative speech characteristic which can be calculated from the first decoded speech.

8. The code conversion method according to claim 6 or 7, wherein the filter is an inverse filter to a post filter, an emphasis filter having characteristics for emphasizing high-band components of frequency, or a filter which is a combination of the inverse filter and the emphasis filter.

9. A code conversion apparatus for converting first code string data into second code string data, the apparatus comprising:

a speech decoding circuit for decoding the first code string data to generate a first decoded speech;

a signal characteristic correcting circuit for correcting signal characteristics of the first decoded speech to generate a second decoded speech; and a speech encoding circuit for encoding the second decoded speech to generate the second code string data.

10. The code conversion apparatus according to claim 9, wherein the signal characteristic correcting circuit corrects the signal characteristics of the first decoded speech by a filter having characteristics which vary in accordance with characteristics of the first decoded speech.

11. The code conversion apparatus according to claim 10, wherein the characteristics of the filter are varied using at least one of frame type information included in the first code string data, size of the first code string data, and a representative speech characteristic which can be calculated from the first decoded speech.

12. The code conversion apparatus according to claim 10 or 11, wherein the filter is an inverse filter to a post filter, an emphasis filter having characteristics for emphasizing high-band components of frequency, or a filter which is a combination of the inverse filter and the emphasis filter.

13. The code conversion apparatus according to claim 9, wherein said signal characteristic correcting circuit corrects the signal characteristics of the first decoded speech by reducing signal characteristics which cause deterioration of the second decoded speech before re-encoding the first decoded speech to generate the second decoded speech.

14. The code conversion apparatus according to claim 13, wherein the signal characteristic correcting circuit corrects the signal characteristics of the first decoded speech by a filter having characteristics which vary in accordance with characteristics of the first decoded speech.

15. The code conversion apparatus according to claim 14, wherein the characteristics of the filter are varied using at least one of frame type information included in the first code string data, size of the first code string data, and a representative speech characteristic which can be calculated from the first decoded speech.

16. The code conversion apparatus according to claim 14 or 15, wherein the filter is an inverse filter to a post filter, an emphasis filter having characteristics for emphasizing high-band components of frequency, or a filter which is a combination of the inverse filter and the emphasis filter.

17. A tangible computer readable medium having stored therein a program for causing a computer to execute a method of code conversion, the program including computer executable instructions for performing the steps of:

decoding a first code string data to generate a first decoded speech;

correcting signal characteristics of the first decoded speech to generate a second decoded speech; and encoding the second decoded speech to generate a second code string data.

18. A tangible computer readable medium having stored therein a program for causing a computer to execute a method of code conversion, the program including computer executable instructions for performing the steps of:

decoding a first code string data to generate a first decoded speech;

correcting signal characteristics of the first decoded speech using a filter having characteristics which vary in accordance with characteristics of the first decoded speech to generate a second decoded speech; and encoding the second decoded speech in accordance with a second speech coding scheme to generate a second code string data conforming to the second speech coding scheme.

19. The tangible computer readable medium having stored therein a program according to claim 18, wherein the characteristics of the filter are varied using at least one of frame type information included in the first code string data, size of the first code string data, and a representative speech characteristic which can be calculated from the first decoded speech.

20. The tangible computer readable medium having stored therein a program according to claim 19, wherein the filter is an inverse filter to a post filter, an emphasis filter having characteristics for emphasizing high-band components of frequency, or a filter which is a combination of the inverse filter and the emphasis filter.

21. The tangible computer readable medium having stored therein a program according to claim 18, wherein the filter is an inverse filter to a post filter, an emphasis filter having characteristics for emphasizing high-band components of frequency, or a filter which is a combination of the inverse filter and the emphasis filter.

22. A tangible computer readable medium having stored therein a program for causing a computer to execute a method of code conversion, the program including computer executable instructions for performing the steps of:

decoding a first code string data to generate a first decoded speech;

correcting signal characteristics of the first decoded speech by reducing signal characteristics which cause deterioration of the second decoded speech before re-encoding the first decoded speech to generate the second decoded speech; and encoding the second decoded speech to generate the second code string data.

23. A tangible computer readable medium having stored therein a program for causing a computer to execute a method of code conversion, the program including computer executable instructions for performing the steps of:

decoding a first code string data to generate a first decoded speech;

correcting signal characteristics of the first decoded speech by reducing signal characteristics which cause deterioration of the second decoded speech before re-encoding the first decoded speech, using a filter having characteristics which vary in accordance with characteristics of the first decoded speech, to generate a second decoded speech signal; and encoding the second decoded speech to generate the second code string data.

24. The tangible computer readable medium having stored therein a program according to claim 23, wherein the filter is an inverse filter to a post filter, an emphasis filter having characteristics for emphasizing high-band components of frequency, or a filter which is a combination of the inverse filter and the emphasis filter.

25. A tangible computer readable medium having stored therein a program for causing a computer to execute a method of code conversion, the program including computer executable instructions for performing the steps of:

decoding a first code string data to generate a first decoded speech;

correcting signal characteristics of the first decoded speech by reducing signal characteristics which cause deterioration of the second decoded speech before re-encoding the first decoded speech, using a filter having characteristics which vary in accordance with characteristics of the first decoded speech, to generate a second decoded speech signal;

encoding the second decoded speech to generate the second code string data conforming to the second speech coding scheme; and varying the characteristics of the filter using at least one of frame type information included in the first code string data, size of the first code string data, and a representative speech characteristic which can be calculated from the first decoded speech.

26. The tangible computer readable medium having stored therein a program according to claim 25, wherein the filter is an inverse filter to a post filter, an emphasis filter having characteristics for emphasizing high-band components of frequency, or a filter which is a combination of the inverse filter and the emphasis filter.

* * * * *